United States Patent [19]

Makedonski et al.

[11] Patent Number: 4,549,370

[45] Date of Patent: Oct. 29, 1985

[54] MACHINE FOR FINISHING COMPLEX PROFILED WORKPIECES

[75] Inventors: Boris G. Makedonski; Haralampi A. Atanassov, both of Sofia, Bulgaria

[73] Assignee: Centralen Mashinostroitelen Institute, Sofia, Bulgaria

[21] Appl. No.: 458,997

[22] Filed: Jan. 18, 1983

[30] Foreign Application Priority Data

Jan. 18, 1982 [BG] Bulgaria ..... 55025

[51] Int. Cl.[4] ..... B24B 31/08

[52] U.S. Cl. ..... 51/7; 51/19

[58] Field of Search ..... 51/7, 17, 19, 317, 161, 51/163.1, 163.2

[56] References Cited

U.S. PATENT DOCUMENTS

| | | | |
|---|---|---|---|
| 2,589,782 | 3/1952 | Creek | 51/19 |
| 2,664,676 | 1/1954 | Cüppers | 51/7 |
| 4,170,849 | 10/1979 | Sakulevich et al. | 51/7 |
| 4,211,041 | 7/1980 | Sakulevich et al. | 51/7 |
| 4,240,229 | 12/1980 | Ohno | 51/7 |

FOREIGN PATENT DOCUMENTS

| | | | |
|---|---|---|---|
| 46-10399 | 3/1971 | Japan . | |
| 0480535 | 12/1975 | U.S.S.R. | 51/317 |
| 0508389 | 5/1976 | U.S.S.R. | 51/161 |

*Primary Examiner*—James G. Smith
*Assistant Examiner*—Robert A. Rose

[57] ABSTRACT

Machine for finishing complex profiled workpieces having a rotating barrel where the workpieces are machined in an loading/unloading unit, for example, a manipulator with grippers. The barrel has a torus-shaped work area defined by a bottom and cylindrical walls fixed to the bottom and the torus-shaped work area of the barrel is closed at the top with a stationary magnetic pole piece. In the center of the torus-shaped work area there is located an electromagnetic coil and a disc mounted on the magnetic pole piece through a fixed shaft. The cylindrical walls of the torus-shaped work area are made of non-ferromagnetic material while the bottom of the shaft and the disc are made of ferromagnetic material. The advantages of the machine are that the quality of the surfaces as machined is improved without changes in the geometry of the workpieces, and machining is carried out on preselected surfaces only.

1 Claim, 4 Drawing Figures

MACHINE FOR FINISHING COMPLEX PROFILED WORKPIECES

The invention relates to a machine for finishing, for example, polishing, complex profiled workpieces.

A machine for finishing workpieces is known to those familiar with the art (Japanese Pat. No. 4610399) comprising a rotating barrel wherein the workpieces are machined, and a loading/unloading unit. Said loading-/unloading unit for feeding workpieces to the barrel and their disposal after machining is designed as a manipulator with grippers. The barrel wherein the workpieces are machined is rotated and its work area is of torus shape defined by a bottom and cylindrical walls fixed to the bottom. An abrasive mixture is introduced into said work area.

A disadvantage of the above-known machine is the unfavorable rounding off of some edges when polishing complex profiled workpieces.

An object of the present invention is to provide a machine for finishing, for example polishing, complex profiled workpieces that enables the machining of preselected surfaces only.

This object is achieved with the machine of the present invention. Such machine comprises a rotating barrel where the workpieces are machined, and a loading/unloading unit that is, in fact, a manipulator with grippers. Said barrel has a torus-shaped work area defined by a bottom and cylindrical walls, said walls being fixed to the bottom. In accordance with a first embodiment of the invention said torus-shaped work area of the barrel is closed at the top by a stationary torus-shaped magnetic pole piece, and in its center there are provided an electromagnetic coil and a disc mounted on said magnetic pole piece through a fixed shaft. The cylindrical walls of the torus-shaped work area are made of non-ferromagnetic material and the bottom shaft and disc are made of ferromagnetic material. The barrel bottom is rotatably supported on the fixed shaft through a flange.

In accordance with a second embodiment of the invention the machine for magnetic abrasive finishing of complex profiled workpieces comprises six work stations disposed above the work area of the centrifugal barrel, said barrel having a lower, fast rotating magnetic pole. Each work station has its own electric motor, a reduction gear and a spindle that carries the chuck for clamping the workpiece. All work stations, along the top magnetic lead, are driven to index them by a separate electric motor and a gear drive. The work stations are powered through a central contact commutator. In a first work position the work stations are moved upwards by air cylinders, so that finished workpieces are unloaded and workpieces to be machined are loaded. In all other positions the work stations are lowered into their seats in the magnetic pole piece.

An advantage of the present invention is the improved quality of the surfaces machined without any changes in workpiece geometry, and further, preselected surfaces only are machined.

Reference will be made, by way of example, to the accompanying drawings, in which.

Figure 1:
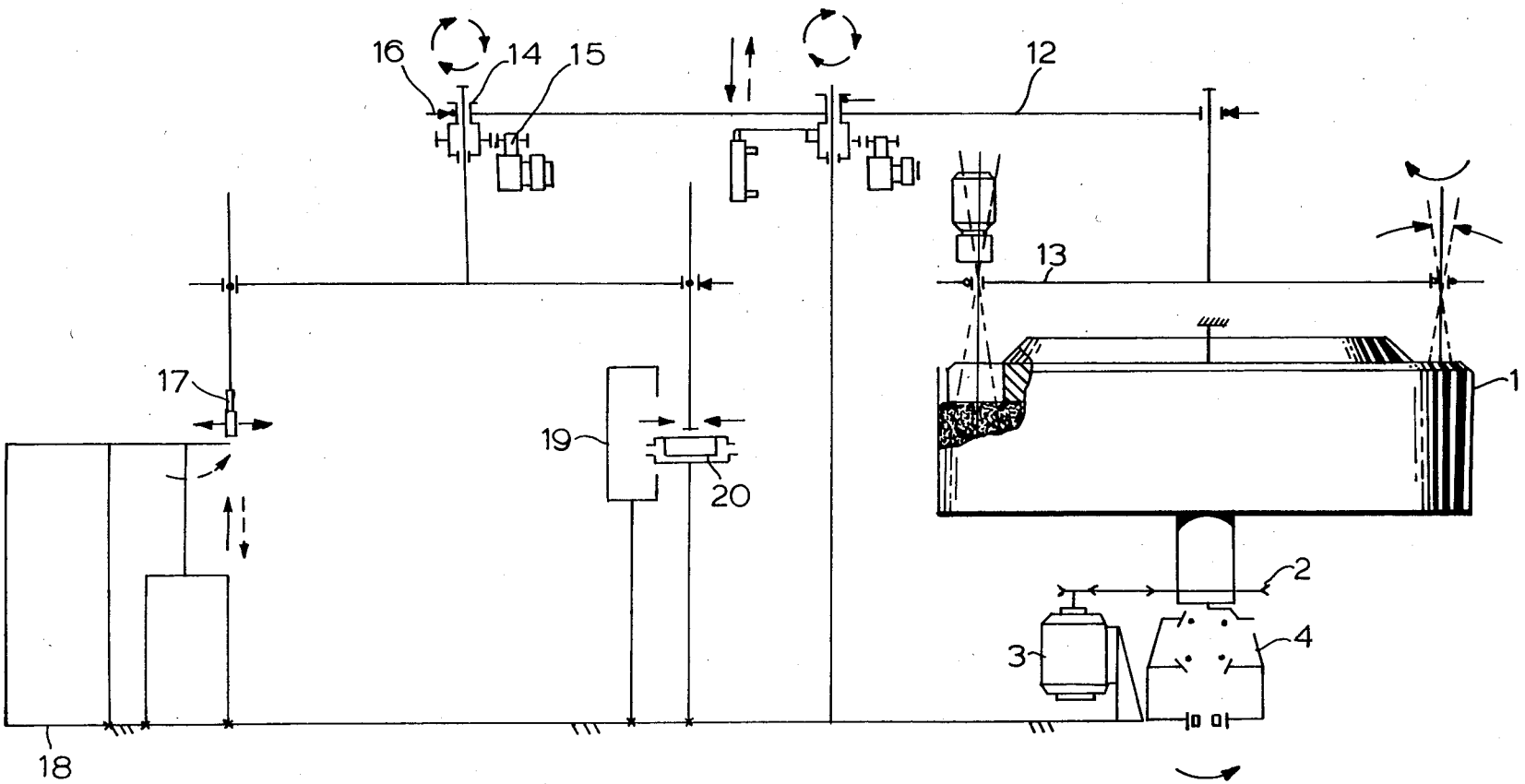
FIG. 1 is a schematic diagram of the machine.

The machine (FIG. 1) for finishing complex profiled workpieces comprises a barrel 1, driven through belt drive 2 by an electric motor 3. Said barrel 1 is rotatably supported in casing 4, and as shown in FIG. 2, has a torus-shaped work area 5, defined by a bottom 6 and cylindrical walls 7, said walls being fixed to said bottom 6. In the center of said torus-shaped work area 5, which is closed at the top by a stationary toroidal magnetic pole piece 8 there is provided an electromagnetic coil 9 and a disc 10 mounted on a fixed shaft 11 attached to said stationary torus-shaped magnetic pole piece 8.

Bottom 6, fixed shaft 11, and disc 10 are made of ferromagnetic material and cylindrical walls 7 of the torus-shaped work area 5 are made of non-ferromagnetic material. Bottom 6 of barrel 1 is rotatably supported on fixed shaft 11 through a flange 21.

Figure 2:
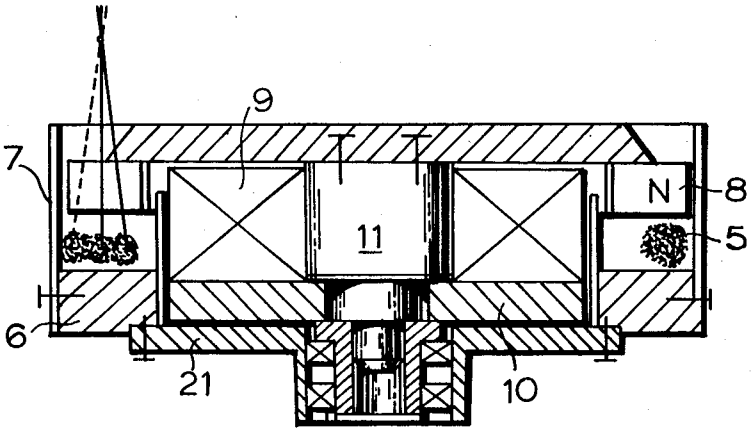
FIG. 2 is a diametrical axial section of the barrel.

The finishing machine can optionally have several barrels 1 arranged along a circle in the center of which there is provided workpiece loading/unloading unit, for example a manipulator with grippers 12 (FIG. 1). Grippers 12 of the manipulator can travel in vertical direction and rotate about their respective axes. Upon said grippers 12 of the manipulator there are mounted plates 13 through bearings 14, an indexing mechanism 15, and a fixing mechanism 16. To said plates 13 there are secured collet attachments 17 for clamping workpieces to be machined. The workpieces are fed to said collet attachments 17 by an oriented-feeding unit 18, and when machining is completed they are removed from said collet attachments 17 by a conveying discharge unit 19, fitted with an inspection block 20.

The operation of the machine in accordance with FIG. 1 is as follows:

A ferromagnetic abrasive mixture, which may be that disclosed in the applicants' coassigned contemporaneously filed application, Ser. No. 458,897, is introduced into the torus-shaped work area 5 of barrel 1; workpieces are then fed to collet attachments 17 by the oriented-feeding unit 18. The manipulator is actuated and its grippers move upwardly in a vertical direction, then they turn with collet attachments 17 above the torus-shaped work area 5 of barrel 1. Said barrel 1 begins to rotate and grippers 12 of the manipulator along with collet attachments 17 move downwards until the workpieces are immersed in the ferromagnetic abrasive mixture filling the torus-shaped work area 5 of barrel 1. When electromagnetic coil 9 is energized it generates an oriented electromagnetic field.

The workpieces rotate, and some preselected surfaces are polished.

After the machining operation is completed, grippers 12 of the manipulator travel and rotate anew and the workpieces enter the work area of other barrels wherein they are machined in the same manner but in varied directions of rotation about their axis. After the machining is finally completed, the components reach the initial starting station, they are relieved of the collet attachments 17 by the conveying discharge unit 19, which is fitted with inspection block 20.

Figure 3:
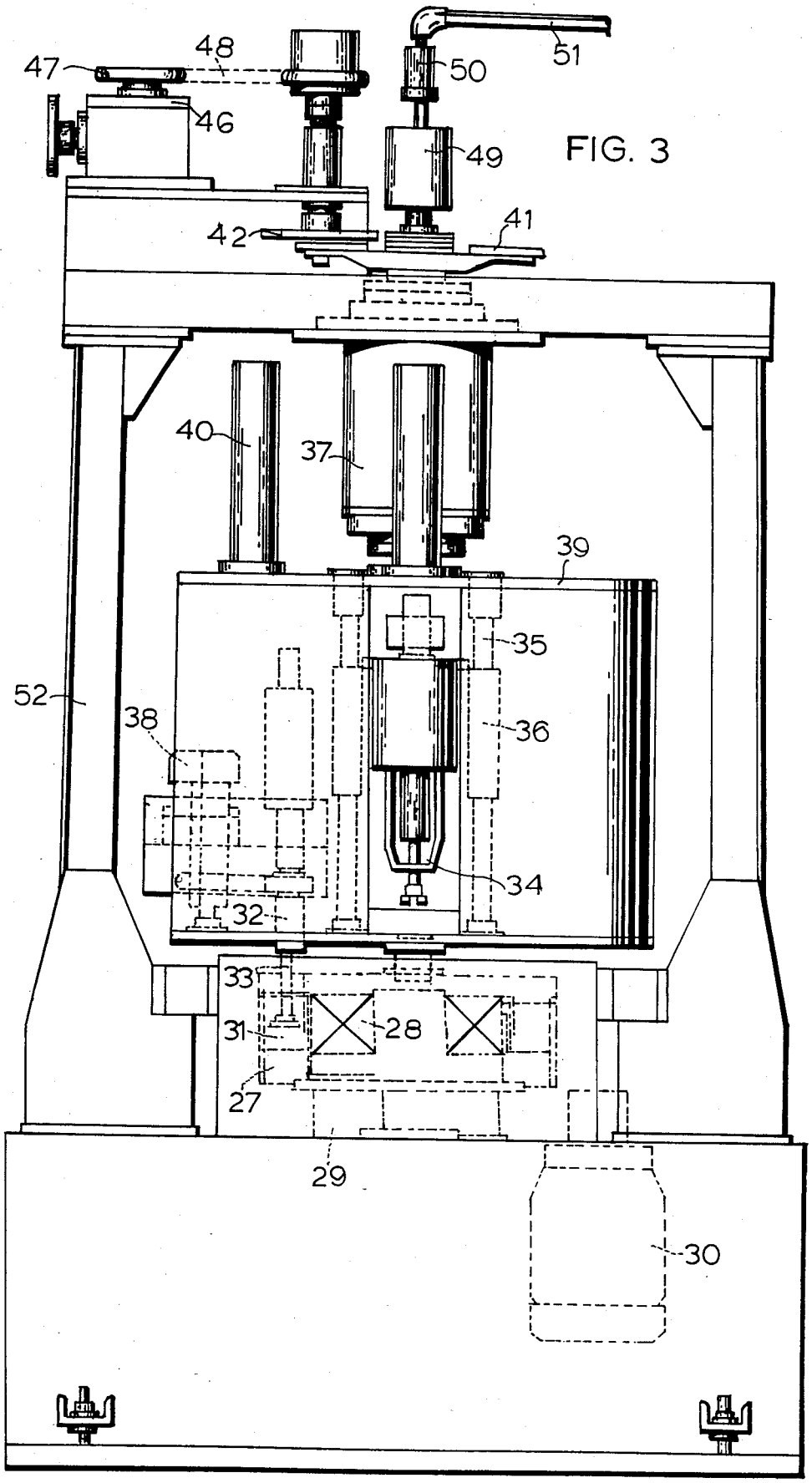
FIG. 3 is a side view of an embodiment of the machine provided with six work stations.
Figure 4:
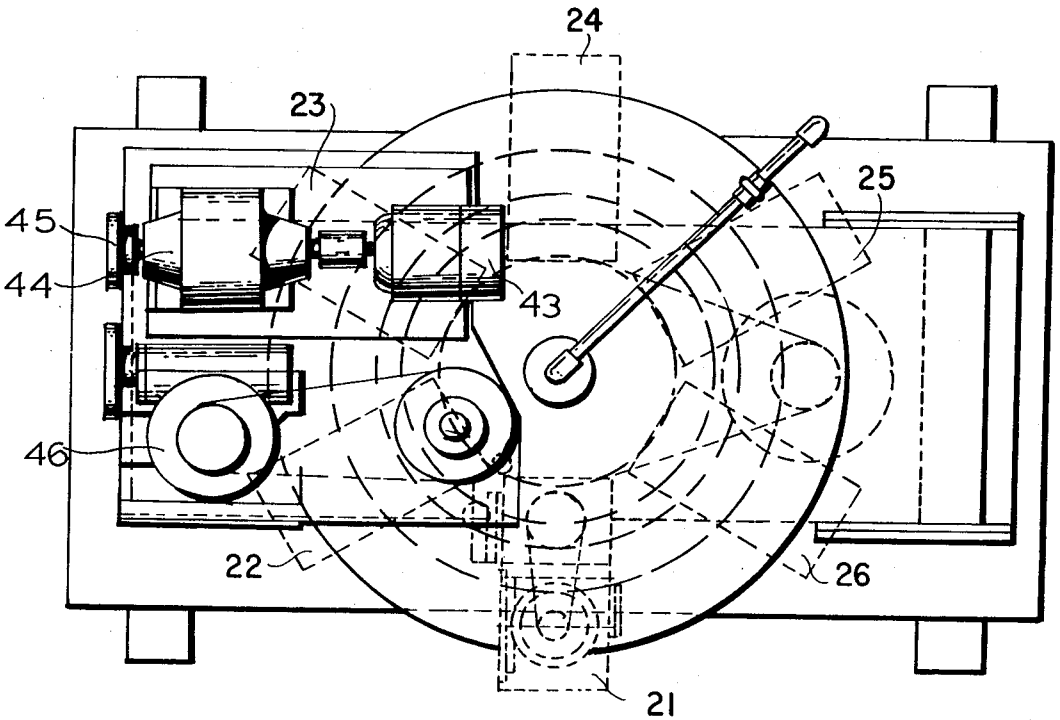
FIG. 4 is a top view of the machine shown in FIG. 3.

The machine in accordance with FIGS. 3 and 4 comprises six work stations 21–26, incl., each one of which is a self-contained unit with its own electric motor 38, spindle 32, and chuck 33. Each motor 38 via a reduction gear actuates the related spindle 32 to which a chuck 33 carrying the workpiece is attached. Each work station (21–26) has two ball guides 36 that when actuated by air cylinders 40 travel vertically along guideways 35. Each chuck 33 carrying the workpiece passes through closing caps 34, and said caps enter the central space in toroidal magnetic pole piece 8 (FIG. 3) of magnetic centrifugal barrel 27 which close the top of work area 31. Coil 28 generates magnetic field in work area 31. Said barrel 27 is actuated from electric motor 30 and belt drive 29.

The six work stations (21–26) each have ball guides 36 and guideways 35 fitted between two discs and air cylinders 40 for vertical travel, which are disposed above upper disc 39.

Electric motor 43 via coupling 44, chain gear drive 45, reduction gear 46, and a second chain gear drive 47, 48 actuates a disc with a cog 42; said cog sequentially enters radial slots in a Geneva wheel 41, whereby indexing of the whole system is effected. Thus, vertical upward movement of each work station is only possible when the indexing position for the particular work station is achieved.

Air for air cylinders 40 is supplied by an air duct 51 and a pneumatic coupling 50, such air being distributed by an air distributor 37.

All electric motors of the work stations are supplied with power delivered via a contact commutator 49.

Although the invention is illustrated and described with reference to a plurality of embodiments thereof, it is to be expressly understood that it is in no way limited to the disclosure of such preferred embodiments but is capable of numerous modifications within the scope of the appended claims.

We claim:

1. A machine for finishing complex profiled workpieces comprising a plurality of rotating barrels wherein the workpieces are machined, and an unloading/loading unit;

each said barrel having a torus-shaped work area defined by a bottom and cylindrical walls fixed to the bottom;

said torus-shaped work area of each said barrel being closed at its top by a torus-shaped stationary magnetic pole piece;

an electromagnetic coil and a disc mounted on said magnetic pole piece by a fixed shaft in the center of the space surrounded by said torus-shaped work area;

the cylindrical walls of said torus-shaped work area being made of non-ferromagnetic material;

the disc and bottom of the fixed shaft being made of ferromagnetic material;

said work area containing containing a ferromagnetic abrasive mixture;

said bottom of each said barrel being rotatably supported on said fixed shaft through a flange;

said machine further comprising:

a plurality of work stations wherein the workpieces are clamped in a chuck at each of the work stations, means including air cylinders to reciprocate the chucks vertically, and means including electric motors and reduction gears for rotating the chucks;

wherein the top magnetic pole pieces are indexed along with the work stations by a second disc with a cog and a Geneva wheel when said work stations are in their lower position, and it is only in one indexing position that each respective work station is moved upwardly by its air cylinder.

* * * * *